United States Patent [19]

Jackson

[11] Patent Number: 4,955,162

[45] Date of Patent: Sep. 11, 1990

[54] PORTABLE GEM FACETING KIT

[76] Inventor: Clifford Jackson, P.O. Box 646, Burley, Id. 83318

[21] Appl. No.: 354,630

[22] Filed: May 19, 1989

[51] Int. Cl.[5] ..... B24B 7/14

[52] U.S. Cl. ..... 51/125.5; 51/283 R; 51/283 E; 51/268

[58] Field of Search ..... 51/229, 277, 170 R, 51/170 T, 125.5, 283 R, 283 E, 268; 206/349, 223

[56] References Cited

U.S. PATENT DOCUMENTS

| | | | |
|---|---|---|---|
| 2,435,971 | 2/1948 | Ludel | 51/229 |
| 2,573,371 | 10/1951 | Van Leuven | 51/283 |
| 3,818,641 | 6/1974 | Long | 51/125.5 |
| 3,902,283 | 9/1975 | Bean | 51/125.5 |
| 4,136,848 | 1/1979 | McCollum | 248/316.7 |
| 4,272,925 | 6/1981 | Graves | 51/211 R |
| 4,471,581 | 9/1984 | Bernard et al. | 51/125.5 |
| 4,517,770 | 5/1985 | Leibowitz | 51/229 |
| 4,605,190 | 8/1986 | Kamp | 248/316.7 |
| 4,785,587 | 11/1988 | Reich et al. | 51/283 R |

FOREIGN PATENT DOCUMENTS

| | | | |
|---|---|---|---|
| 705650 | 6/1931 | France | 206/223 |

*Primary Examiner*—William E. Terrell
*Assistant Examiner*—Mark F. Frazier
*Attorney, Agent, or Firm*—Trask, Britt & Rossa

[57] ABSTRACT

A gem faceting kit is disclosed which includes a portable carrying case that may be opened to a use position in which it constitutes a utility rack from which other items of the kit may be retrieved and conveniently used. The gem faceting kit includes a gem faceting machine that has a storage and a use position. Also included in the kit are various lap wheels, grinding compounds, a rinse dispenser, a catch basin, a lamp, a visor, and various other tools, chemicals, and compounds used in gem faceting. The entire kit is lightweight and portable.

15 Claims, 6 Drawing Sheets

PORTABLE GEM FACETING KIT

BACKGROUND OF THE INVENTION

1. Field: The present invention is directed toward a gem faceting kit, and particularly toward such a kit housed within a portable container.

2. State of the Art: Faceting machines are used to grind precious gems to present a desired configuration of planar faces or facets. These facets provide the gem with its particular light reflecting characteristics. The beauty of a gem is largely dependent upon its facets.

A faceting machine typically has some form of a base in which is mounted a motor and a vertical rotating arbor. A grinding wheel, commonly known as a lap wheel, is mounted to the arbor. The base of the machine is typically mounted to a bench to hold the base and other parts of the faceting machine in place. However, some faceting machines are available in which the base rests on top of a table under its own weight.

Extending upward from the base is a vertical mast, which is typically a cylindrical rod. A faceting head is slidingly attached to the mast to slide up and down at various vertical locations. A gem is mounted to a dop stick, which is in turn mounted to the faceting head. The faceting head includes mechanisms for reorienting the gem with respect to the lap wheel such that the gem can be ground against the lap wheel at various desired angles and vertical positions to thus facet the gem.

A rinse dispenser, which is some form of liquid container, is typically mounted above the lap wheel to dispense a rinse liquid, such as water, upon the lap wheel as a gem is being faceted. A catch basin, which is a bowl-like container, is typically mounted about the lap wheel to catch liquid and debris from the lap wheel as a gem is faceted. Some type of drain system is also commonly included, such as a tube attached to the catch basin, to drain waste from the catch basin. A lamp is commonly positioned to illuminate the faceting area.

Such faceting machines are convenient and useful for the home hobbyist. Faceting machines themselves are not typically designed to be conveniently transported, however, but are designed to be left in one place, particularly with table-mounted models. Even smaller versions of gem faceting machines typically have bases which are about 10 inches wide and about 14 to 16 inches long. It is not uncommon for a person to have an entire room devoted to the materials necessary to engage in gem faceting.

However, many persons who engage in gem faceting as a hobby, or as a business, may for various reasons wish to facet gems while traveling, at gem shows, or on vacation. With the aforementioned gem faceting machines, it would be inconvenient or impractical to transport all of the materials necessary to engage in gem faceting in the usual travelling environment.

There remains a need for a conveniently portable gem faceting kit which has all of the necessary items for engaging in gem faceting. Such a kit would desirably stored within a compact and portable container, which can be taken with the user while travelling or vacationing. Such a kit would preferably be small and light enough to be carried by a user and easily set up, for example, in a motel room, camper, or motor home.

SUMMARY OF THE INVENTION

A gem faceting kit of the present invention comprises a case having a closed position to constitute an enclosed and portable container and an open position to constitute a rack for convenient retrieval and use of stored items. This gem faceting kit also comprises a gem faceting machine which includes a housing, an arbor mounted in the housing to spin about a vertical axis, and a drive unit mounted in the housing and mechanically linked to the arbor to rotate the arbor. A mast and faceting head are connected to the housing to extend upward from the housing. The mast and faceting head are configured and adapted to be reoriented with respect to the housing in a compact storage position. A plurality of lap wheels are configured to be connected to the arbor. A plurality of dop sticks are formed to be fastened to a gem and connected to the faceting head. A plurality of grinding compounds are also provided. The gem faceting machine in its stored position, the lap wheels, the dop sticks, and the grinding compounds are sized, configured and adapted to be stored in the case with the case in its closed position.

In another embodiment, the gem faceting kit further comprises a rinse dispenser formed and configured to be associated with the gem faceting machine to dispense rinse liquid upon the lap wheel connected to the arbor. The rinse dispenser is configured to be reoriented to a storage position and stored with the case. The gem faceting kit may also include a lamp configured to be associated with the gem faceting machine in a use position and reoriented with respect to the gem faceting machine in a storage position and stored in the case. The gem faceting kit may also include a transfer jig configured to be stored within the case. In a preferred embodiment, the gem faceting kit includes a handle which is configured and positioned for carrying the entire kit by one hand of a user. ,

DETAILED DESCRIPTION OF THE ILLUSTRATED EMBODIMENT

Figure 1:
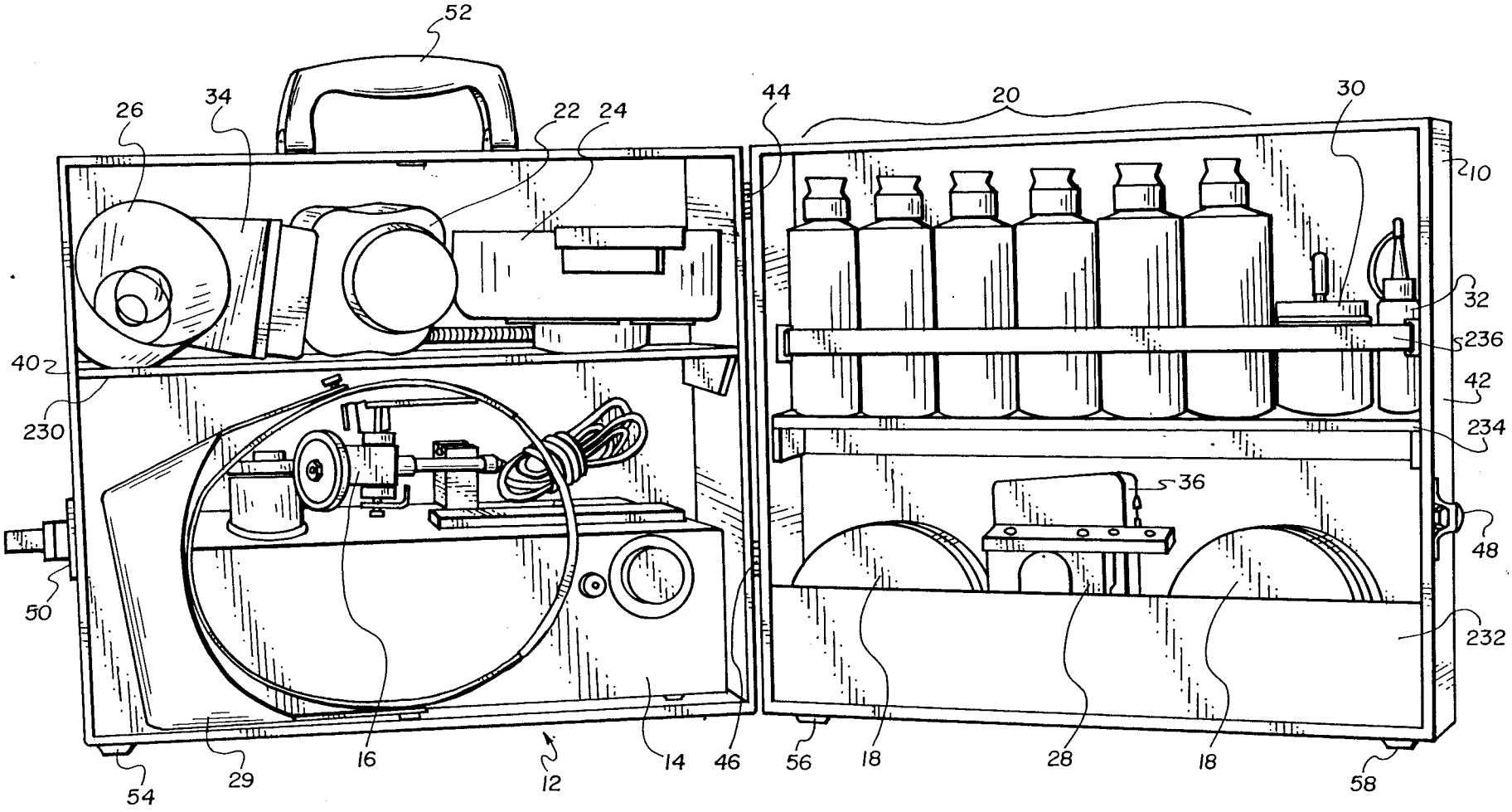
FIG. 1 is a perspective illustration of a gem faceting kit of the invention with the case in its open position.

Referring to FIG. 1, a gem faceting kit of the invention includes a case 10, a gem faceting machine 12 including housing 14 and faceting head 16, lap wheels 18, grinding compounds 20, rinse dispenser 22, catch basin 24, lamp 26, and transfer jig 28. Other items within the kit include a visor 29, alcohol lamp 30, glue container 32, box 34, and box 36.

Figure 2:
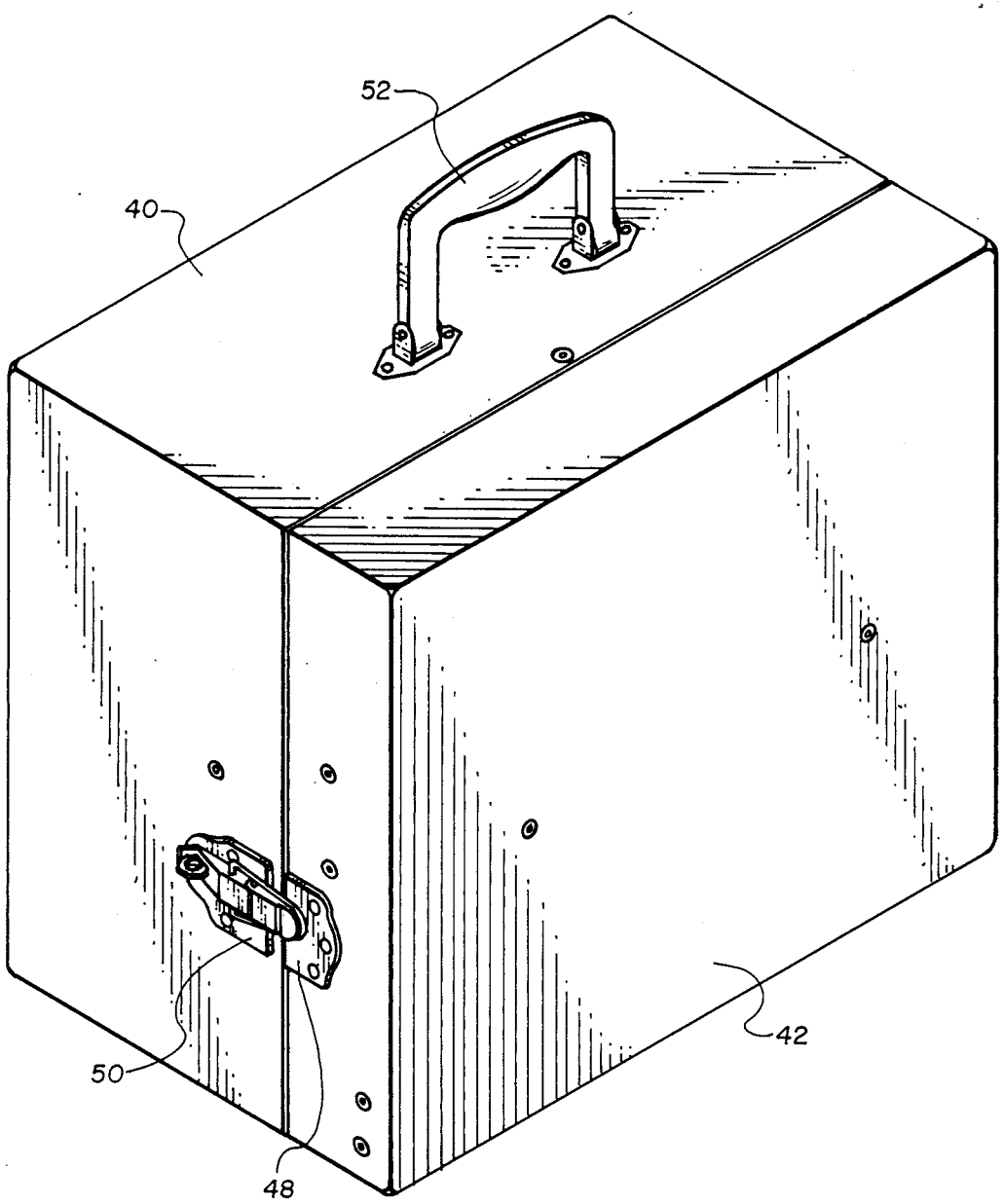
FIG. 2 illustrates a perspective view of a gem faceting kit with the case in its closed position.

As shown, case 10 includes a rectangular box member 40 and rectangular box member 42. Box members 40 and 42 are linked at hinqes 44 and 46. Latch members 48 and 50 are provided to hold the case 10 closed when it is in its closed position A handle 52 is provided to carry case 10 when it is in its closed position. A set of rubberized feet 54, 56, and 58 are provided for resting case 10 on, for example, a table top, when it is in either its open or closed position, as shown in FIGS. 1 and 2.

Rectangular box member 40 of case 10, which is a typical illustrated embodiment of such a case, is approximately 14 inches long, 12 inches high, and approximately 6½ inches deep. Box member 42 of case 10 is approximately 14 inches long, 12 inches high, and approximately 2½ inches deep. With the case 10 in its closed position, as shown in FIG. 2, the entire gem faceting kit is approximately 14 inches long, 12 inches high, and approximately 9 inches in depth. The kit has a total volume in its closed orientation of about 1512 cubic inches, or about 0.875 cubic feet. The entire kit shown in FIG. 1 weighs approximately 31 pounds.

Portable gem faceting kits preferably have a total outside volume in the closed orientation, i.e., for storage or transport, of less than about 2 cubic feet or less, and more preferably less than about 1 cubic foot. However, it may not be unreasonable for less preferred embodiments to have a larger outside volume. For example, a case measuring about 30 inches long, 18 inches high, and about 15 inches deep would amount to about 4.7 cubic feet in volume, and would not be an unusable size for a transportable kit, although it would be somewhat cumbersome, heavy, and not preferred. Portable gem faceting kits of the invention preferably weigh less than about 50 lbs., and more preferably less than about 35 lbs.

Figure 3:
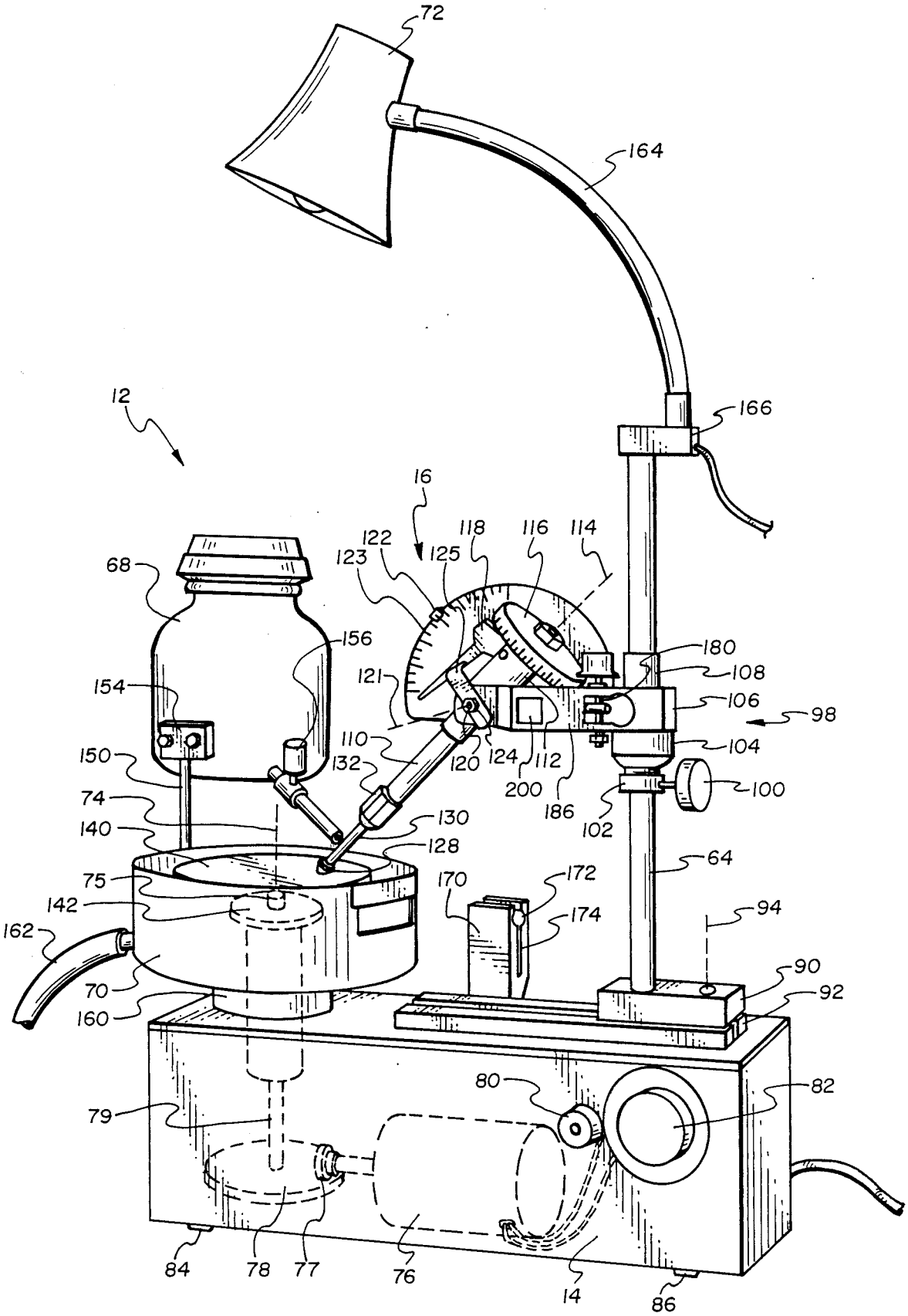
FIG. 3 is a perspective view of a gem faceting machine of the invention with the faceting head in its faceting position.

FIG. 3 illustrates the gem faceting machine generally indicated at 12 in its faceting orientation. The gem faceting machine of FIG. 3 includes a housing 14, mast 64, and faceting head generally indicated at 16. Attached to the faceting machine 12 are a rinse dispenser 68, catch basin 70, and a lamp 72. Mounted within housing 14 is an arbor 75 (shown in phantom lines). Arbor 73 is essentially an axle mounted to rotate about vertical axis 74. A motor 76 (shown in phantom lines) is mounted within housing 14, which is mechanically connected by means of a simple transmission (shown in phantom) which includes a rubber-like wheel 77 registering with a nylon wheel 78, which is in turn mounted on a shaft 79. Shaft 79 is connected to arbor 75 to rotate arbor 73 about axis 74. Motor 76 is electronically connected to an on/off switch 80 and a variable speed dial 82. By means of dial 82, motor 76, and hence arbor 73, can be caused to operate at various desired rotational speeds. Housing 14 is shown to be approximately 11 inches long, 4 inches high, and 4 inches wide. Housing 14 acts as a base for the remainder of the gem faceting machine. Housing 14 rests upon four rubberized feet, of which feet 84 and 86 are typical.

Mast 64 is preferably a solid steel shaft. Mast 64 is connected to housing 14 by means of a foot 90 which is connected to keyway 92. The association between foot 90 and keyway 92 allows mast 64 to be positioned at various positions with respect to arbor 72, and also allows foot 90 to be pivoted about axis 94. The association between foot 90 and keyway 92 is described in more detail hereinafter in reference to FIG. 9.

A vertical stop 98 is provided to be slidingly associated with mast 64 and to hold faceting head 16 at various vertical positions. Vertical stop 98 includes a knurled nut 100 that is threadedly mounted to a lower collar portion 102, which is preferably formed of nylon. An upper collar portion 104 is threadedly associated with lower collar portion 102. Knurled nut 100 may be rotated clockwise to tighten vertical stop 98 and lock vertical stop 98 in position on mast 64. Upper collar portion 104 may be then rotated counterclockwise or clockwise to make minor vertical adjustments in the position of faceting head 16 along mast 64.

Faceting head 16 includes a yoke 106 within which is mounted a collar 108, preferably formed of a friction-resisting material, such as commonly available PVC tubing, which slides upon and rotates about vertical mast 64. A quill 110, preferably formed of a metal such as soft brass, is mounted in a quill bearing 112 to rotate about a rotational axis 114. An index gear 116 is mounted to quill 110 to rotate with quill 110 to indicate the rotational position of quill 110 about axis 114.

A spring-loaded key 118 registers with a series of notches in index gear 116 to preclude index gear 116, and hence quill 110, from rotating within quill bearing 112. Key 110 also acts as an indicator for the relative rotational or angular position of index gear 116 about axis 114. The 360° about index gear 116 are divided into twelve equal gradations. These gradations are then subdivided into eight subgradations, constituting a total of 96 equal angular positions about the 360° along index gear 116. Spring-loaded key 118 registers with any one of these 96 equally spaced gradations, each gradation corresponding to a 3.75° rotation.

Figure 4:
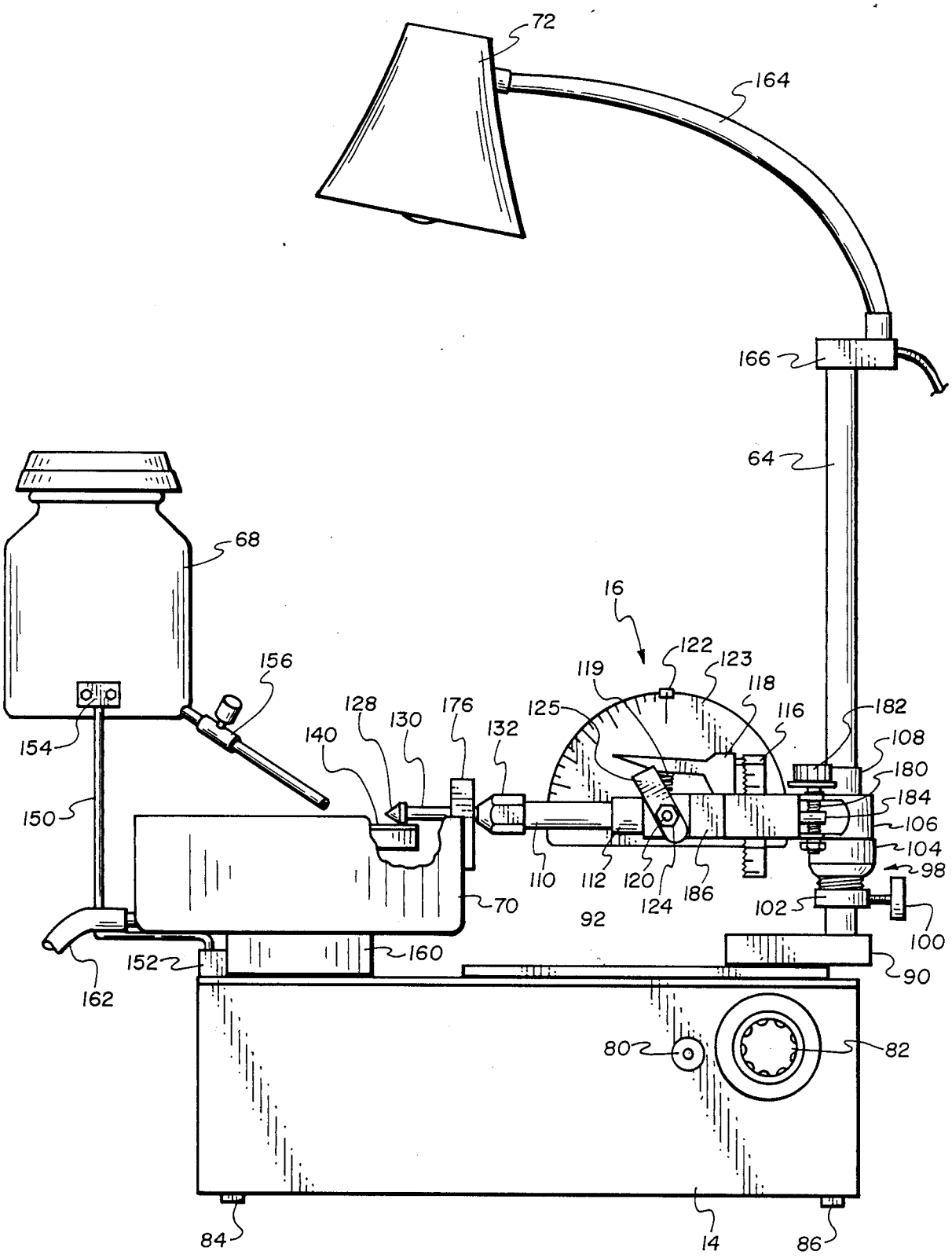
FIG. 4 is a plan, partial cut-away, view of a gem faceting machine of the invention with the faceting head in its girdling position.

The association between spring-loaded key 118 and index gear 116 is more clearly illustrated in FIG. 4. A spring 119 urges key 118 toward index gear 116 which has a plurality of notches as shown, the purpose of which has been described. Key 118 is pivotally associated with yoke 112 to pivot to allow key 118 to engage with index gear 116, as described.

Quill bearing 112 is mounted to yoke 106 at faceting axle 120 to pivot about a horizontal axis 121. A marker 122 is connected to faceting axle 120 to mark the angular position of quill bearing 112 and quill 110 about axis 121 along protractor 123. Protractor 123 is divided into a standard 90 degrees of angular measurement. Axle 120 is threaded to receive a nut 124. Pivotally attached to axle 120 is a finger 125. Nut 124 may be tightened on axle 120 against finger 125 to lock finger 125 in place. Finger 125 is used to preclude quill 110 from rotating in a counterclockwise direction as viewed in FIG. 3 more than a selected amount about axis 121. When quill 110 reaches its maximum selected counterclockwise position, quill bearing 112 registers with finger 125.

A gem 128 which is to be faceted is firmly connected to a dop stick 130, which is in turn firmly mounted within dop chuck 132. Dop chuck 132 is a collet chuck and is part of quill 110. The portion of quill 110 which associates with dop stick 130 is formed of hollow, soft brass which is threaded and sawed lengthwise to form four jaws. Dop chuck 132 is formed to be a hexagonal nut which has a conical inner shape. When the nut 132 is threaded onto quill 110, the nut 132 causes the jaws formed to be pressed inwardly to center the dop stick within the quill and to tighten the dop stick firmly in place.

A lap wheel 140, which is essentially a specialized grinding disk used in faceting gems, is mounted to arbor 75. Arbor 73 is threaded to engage with a receiving set of threads on the underside of lap wheel 140. Arbor 75 also includes a base 142 to register with and support the underside of a lap wheel. In this advantageous arrangement, no center nut is needed on the top of and in the center of lap wheel 140 to hold lap wheel 140 to arbor 75. Thus, more of the lap wheel can be used, and the user need not be concerned about striking the gem against a nut in the center of the lap wheel, such as is commonly encountered in gem faceting machines This lack of a center nut also allows the lap wheel to be smaller than usual, increasing the compactness and lightweight nature of the disclosed gem faceting machine.

A rinse dispenser 68 is mounted by means of a rod 150 to housing 14. This mounting is more clearly seen in FIG. 4. Rod 150, preferably formed of steel, mounts to a nylon block 152 mounted to housing 14. A similar block 154 is mounted to rinse dispenser 68. Rod 150 fits into slightly smaller holes (i.e., by means of a press-fit relationship) formed in nylon blocks 152 and 154. Dispenser 68 includes a stopcock 156 which allows the user to dispense a selected flow rate of rinse liquid from dispenser 68 onto a lap wheel 140 as a gem is being faceted. Dispenser 68 dispenses a rinse liquid, which is typically water. Rinse dispenser 144 can be conveniently detached from housing 14 by pulling dispenser 68 and block 154 from rod 150, and rod 150 from block 152. Dispenser 68 and rod 150 can then be stored within case 10.

Catch basin 70 serves to catch rinse liquid, polishing compounds and other waste that is dispersed from lap wheel 140 as a gem is faceted. Catch basin 70 has a collar 160 which connects on the inside to an associating shoulder mounted to housing 14. Catch basin 70 is preferably formed of a plastic material and can be easily removed from housing 14 once lap wheel 140 is removed. Catch basin 70 is provided with a drain tube 162 to allow waste and residue in catch basin 70 to drain to a disposal area, which can be, for example, a plastic bag connected to the bottom of tube 162.

A lamp 72 is provided to illuminate the faceting machine. Lamp 72 has a flexible coiled metal neck 164 which allows lamp 72 to be placed in various positions to illuminate the faceting area according to the desire of the user. Lamp 72 is connected to the top of mast 64 by means of a nylon foot 166, which has a hole slightly smaller than the diameter of mast 64 to engage with mast 64 in a press-fit relationship. Thus, lamp 72 may be removed from mast 64 and stored within case 10.

Referring to FIG. 3, mounted to housing 14 is a nylon shoe 170, which includes a rounded or horseshoeshaped opening 172, as shown, and a longitudinal slot 174, as shown. Nylon shoe 170 is used to hold mast 64 and faceting head 16 in its storage position with respect to housing 14 when the gem faceting machine is stored within case 10. Opening 172 is sized so that it receives, in a press-fit relationship, mast 64. Slot 174 allows opening 172 to expand sufficiently to accept mast 64. This storage position is described more completely hereinafter.

FIG. 4 illustrates the gem faceting machine of FIG. 3 in its girdling orientation. As shown in FIG. 4, indicator 122 is at the marking indicating 90°, which indicates that the quill 110 is horizontal. In this orientation, the process known as girdling is performed upon a gem 128. In the girdling process, a series of facets are placed around the girdle portion of the gem. These facets serve as a basis for grinding the other facets on the gem. After the gem is girdled in this fashion, foot 90 can be loosened from keyway 92 and rotated 180° to the orientation shown in FIG. 3. The horizontal distance which mast 64 moves closer to arbor 72, effected by this rotation, is roughly equivalent to the distance which the mast should be moved in order to engage in subsequent faceting procedures.

A foam or sponge block 176 is inserted into catch basin 70 to preclude waste from coming out of catch basin 70. Sponge block 176 has a vertical slot 177 (see FIG. 9) to allow dop stick 130 to be placed through the sponge onto lap wheel 140. (See FIG. 8) As shown in FIG. 3, when sponge 176 is not in place for girdling, a plate 178 is preferably inserted into the opening made in catch basin 70 to keep waste from being splattered from catch basin 70. Plate 178 may be formed of, for example, plastic or aluminum.

Another feature of the illustrated faceting machine is radial cheater 180. Radial cheater 180 includes a threaded bolt 182 which can be turned to, in turn, urge a nut 184 upward or downward to rotate yoke portion 186 about yoke portion 106. Yoke portion 186 is pivotally attached to yoke portion 106 to pivot about an axis which would be generally collinear to the rotational axis of quill 110 in the orientation shown in FIG. 4.

Figure 9:
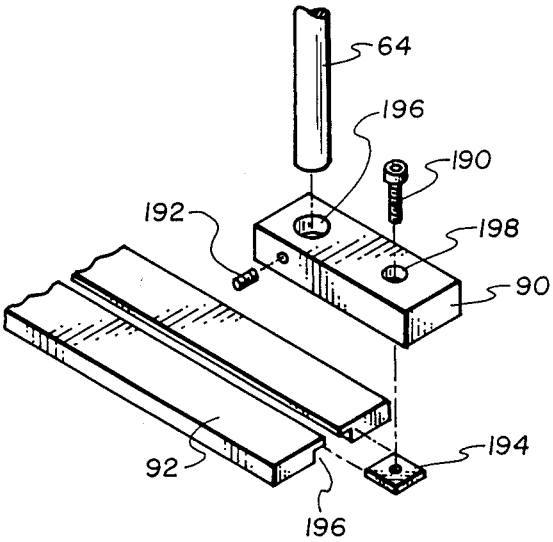
FIG. 9 is an exploded, perspective view of a foot and keyway assembly of the invention.

FIG. 9 illustrates elements of the foot and keyway assembly shown in FIGS. 3 and 4. This assembly includes foot 90, screw 190, keyway 92, screw 192, and rectangular nut 194. Mast 64 is mounted to foot 90, preferably formed of metal, by means of mast 64 being placed in cylindrical bore 196 and locked in place by means of screw 192, which is as shown, a hex key machine screw. Foot 90 is then placed on keyway 92 and screw 190 is threaded into rectangular nut 194, which is slid into notch 196. Screw 190 rests upon a shoulder 198 formed in foot 90 and is thus tightened against rectangular nut 194 to tighten foot 90 in place upon keyway 92. When it is desired to remove mast 64 and faceting head 16 from housing 14, screw 190 is loosened and the foot 90 is slid to the right, as viewed in FIG. 9, from keyway 92 so that the mast and faceting head may be reoriented with respect to housing 14.

Figure 5:
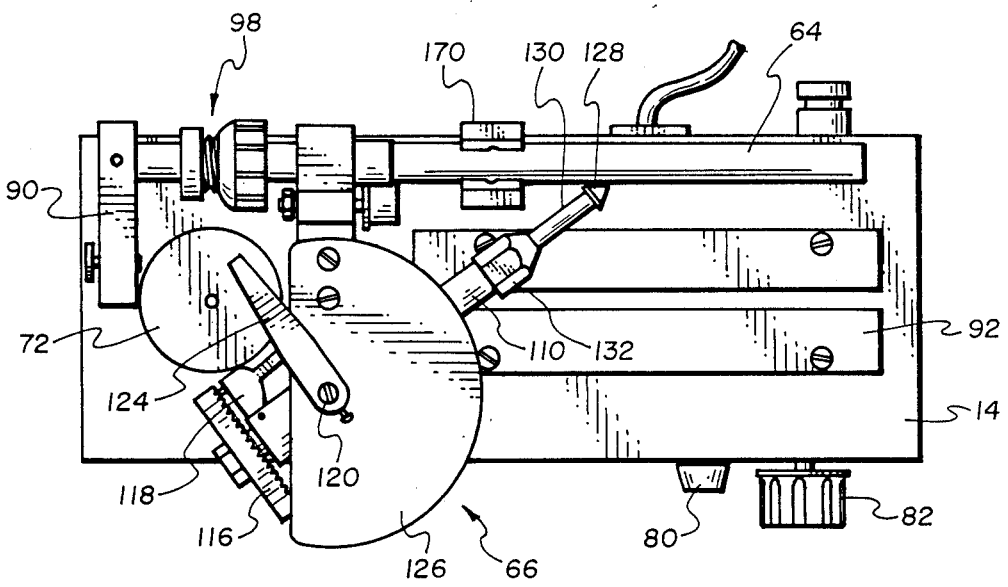
FIG. 5 is a top plan view of a gem faceting machine in its storage position.

The mast and faceting head assembly of FIGS. 3 and 4 is shown in its storage position with respect to housing 14 in FIG. 5. As shown in FIG. 5, the rinse dispenser 68, and rod 150, are removed from housing 14. Lamp 72 is removed from mast 64. In addition, any lap wheels and catch basin 70 are removed. These items are stored in case 10, as shown in FIG. 1. The faceting head 16 and foot 90 are turned as shown in FIG. 5 and mast 64 is clipped into nylon shoe 170, as shown. As shown, faceting head 16 and foot 90 surround arbor 72. A rubber-like pad 200 (see FIG. 1) is mounted to yoke portion 186. Faceting head 16 rests upon rubber-like pad 200 as it rests upon housing 14. In this configuration, the faceting machine constitutes a compact faceting machine assembly in a storage position which may be easily stored within case 10. Dop stick 130 and gem 128 may be either removed from or left within chuck 132, according to the preference of the user.

Figure 6:
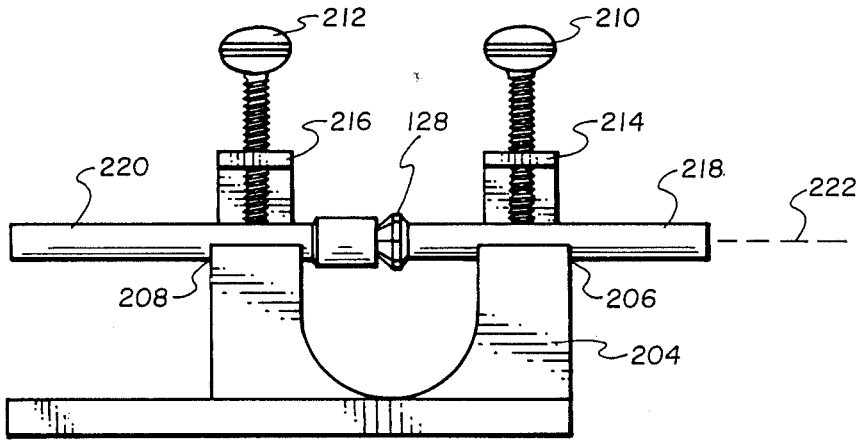
FIG. 6 is a front plan view of a transfer jig of the invention.
Figure 7:
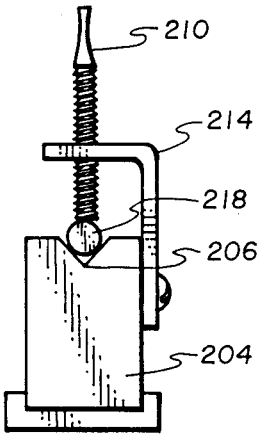
FIG. 7 is a side plan view of the transfer jig of FIG. 7.

FIGS. 6 and 7 illustrate a preferred embodiment of a transfer jig of the invention. The body of this transfer jig includes a yoke 204 having a pair of "V" shaped notches 206 and 208 formed in it. This yoke is preferably formed of a lightweight material such as aluminum. A pair of turn screws 210 and 212 threadably associates with collar portion 214 and 216, respectively, as shown. These threaded screws are used to press dop stick such as dop sticks 218 and 220, which are of the same outside diameter so that dop stick 218 and 220 have exactly collinear longitudinal axes, such as axis 222. A gem 128, after it has been faceted, can then be transferred from dop stick 218 to dop stick 220 to maintain the gem 128 in collinear axial orientation to its orientation when connected to dop stick 218. The other side of the gem 128 can then be faceted.

Figure 8:
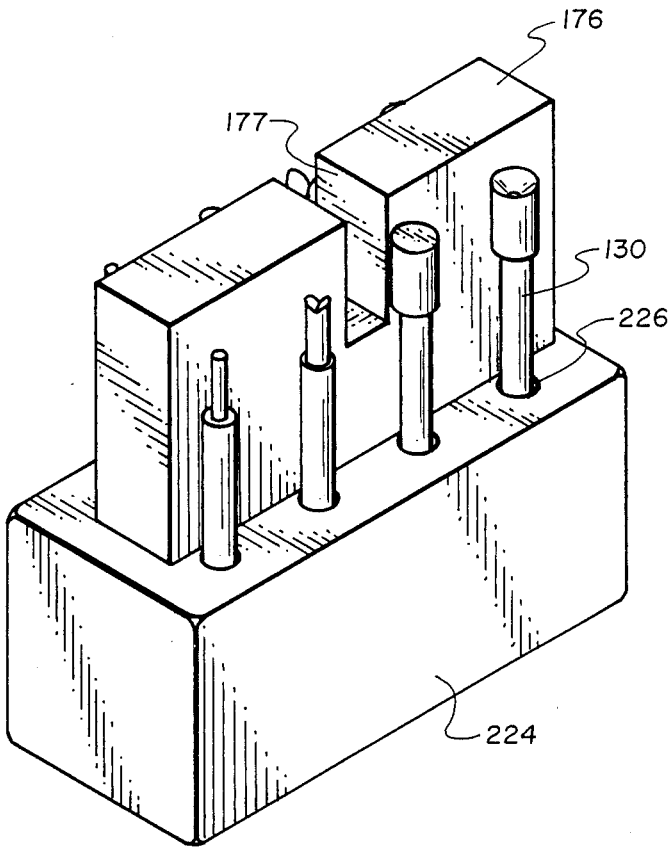
FIG. 8 is a perspective illustration of a dop stick holder and girdling sponge.

FIG. 8 illustrates a storage assembly for the various dop sticks and girdling sponge 176. Block 224, which may be formed of, for example, wood or plastic, has a plurality of holes bored into it, of which hole 226 is typical. These holes are formed to store a plurality of dop sticks, of which dop stick 130 is typical, as shown. Girdling sponge 176 is placed in between the dop sticks, as shown, for storage. This entire assembly is placed in the lower left-hand corner of box member 40, as shown in FIG. I, behind visor 28, so as to not be visible in the configuration shown in FIG. 1.

Referring now again to FIG. 1, with the gem faceting machine 12 in its orientation shown in FIG. 6, faceting machine 12 can be stored within case 10, as shown, with other items of the gem faceting kit, which have been described, also stored in the case 10, as shown. Containers 20 contain various solutions used in the grinding and faceting process and include, for example, cerium oxide, diamond lubricant, and alumna solution, tin oxide solution, distilled water, and liquid soap. Glue container 32 typically contains a quick-setting, high-strength glue. Box 34 and box 36 are plastic boxes that contain various items such as wrenches, hex keys, heat-sensitive glue compound for mounting gems to the dop stick, and other compounds used in faceting gems such as diamond powders of various particle size. Visor 29 has magnifying lenses to allow the user to inspect a gem more closely while it is being faceted. Drain tube 162 may be rolled up and stored within rinse dispenser 22 when it is stored within case 10 as shown in FIG. 1. Plastic bags which are to be used at the bottom of drain tube 162, to contain residue, may also be stored within catch basin 24 as shown in FIG. 1.

As shown, case 10 has various compartments provided by shelves and other components now described. In case member 40, a horizontal shelf 230 is attached within the walls of and above the midpoint of member 40, as shown. The portion of box member 40 below shelf 230 constitutes a first compartment, mainly for the storage of the gem faceting machine 12. A vertical retaining member 232 is provided in box member 42, as shown, to provide a second compartment, mainly for lap wheels 18 and other items of the gem faceting kit, as shown. Box member 42 also includes a horizontal shelf 234. A third compartment is provided above shelf 234, mainly for the storage of the grinding compound containers 20 and other items, as shown. Box members 40 and 42, and members 230, 232 and 234 are formed of any suitable lightweight material, such as wood or plastic. Elastic member 236 is attached to box member 42 to hold the grinding compound containers 20 and other items from falling out of the third compartment. Elastic member 236 may be, for example, a rubber band. A fourth compartment is provided in box member 40 above shelf 230, mainly for the storage of lamp 26, rinse dispenser 22, catch basin 24, and other items as shown.

Case 10, with other elements of the illustrated embodiment of the gem faceting kit stored within case 10 as shown in FIG. 1, and with the case 10 in its closed position as shown in FIG. 2, constitutes a portable gem faceting kit which may be conveniently moved from place to place and carried by one hand of a user, i.e. by handle 52. The gem faceting machine 12 contained within the lower left-hand shelf of box 40 is small and lightweight when compared to typical gem faceting machines, yet it can be used to facet gems with the same accuracy as typical larger and heavier faceting machines.

When the user arrives at a particular location in which he desires to facet gems, he simply unlocks the cases at latches 48 and 50, opens the case, and sets up the gem faceting machine as shown in FIGS. 3 and 4. The various lap wheels, grinding compounds, solutions, and other items may be conveniently retrieved from and returned to case 10 with the case in its position shown in FIG. 1 so that these items can be used conveniently with the gem faceting machine. Case 10 thus acts as a convenient utility rack for display and retrieval of items to be used with the gem faceting machine. When the user has completed the faceting, he merely removes rinse dispenser 22, the lap wheel, catch basin 24 and lamp 26 from the gem faceting machine and places them, as shown in FIG. 1, in case 10. Foot 90 is loosened from keyway 92, and the mast 64 and faceting head 16 are reoriented and clipped to housing 14, as shown in FIG. 5. This assembly is then also placed in case 10 as shown in FIG. 5. The case is closed and it is again ready to be transported to other locations or conveniently stored for future use.

Reference herein to details of the illustrated embodiment is not intended to limit the scope of the appended claims, which themselves recite those features regarded as important to the invention.

I claim:

1. A gem faceting kit comprising:

a case having associating members adapted to operate between a closed position to constitute an enclosed and portable container carrying and storing a gem faceting machine having a removable mast and faceting head and a plurality of lap wheels, a plurality of dop sticks and a plurality of containers for grinding compounds, and an open position to constitute a rack for convenient retrieval and use of said stored items;

a gem faceting machine, including:

a housing, an arbor mounted in said housing to spin about a vertical axis, a drive unit mounted in said housing and mechanically linked to said arbor to rotate said arbor, an upright mast and faceting head removably connected to said housing to extend upward from said housing, a keyway having an open end attached to said housing for removably connecting said mast to said housing in an upright position, mast storage means attached to said housing for securing said mast to said housing in a storage position reoriented from its upright position, wherein said mast and faceting head are configured and adapted to be reoriented with respect to said housing in a compact storage position;

a plurality of lap wheels configured to be connected to said arbor;

a plurality of dop sticks formed to be fastened to a gem and connected to said faceting head;

a plurality of containers for grinding compounds;

wherein said gem faceting machine in said storage position has said mast removed from its upright position and secured to said housing in a reoriented position, said lap wheels, said dop sticks, and said containers for grinding compounds are sized, configured and adapted to be stored in said case; and wherein said case has a plurality of storage compartments for items of said kit stored in said case.

2. A gem faceting kit according to claim 1, further comprising a rinse dispenser formed and configured to be associated with said gem faceting machine to dispense rinse liquid upon a said lap wheel connected to said arbor, said rinse dispenser being sized, configured, and adapted to be reoriented to a storage position and stored within said case.

3. A gem faceting kit according to claim 1, further comprising a lamp sized, configured, and adapted to be associated with said gem faceting machine in a use position and reoriented with respect to said gem faceting machine in a storage position and stored in said case.

4. A gem faceting kit according to claim 1, further comprising a transfer jig sized and configured to be stored within said case.

5. A gem faceting kit according to claim 1, wherein said case includes a handle configured and positioned for carrying said kit, with said case in said closed position, by one hand of a user.

6. A gem faceting kit according to claim 1, wherein said case is less than about 2 cubic feet in volume.

7. A gem faceting kit according to claim 1, wherein said case is less than about 1 cubic foot in volume.

8. A gem faceting kit comprising:

a case having a pair of hinged members sized, configured, and adapted to store items of said kit and to hingingly operate between a closed position to constitute an enclosed and portable container carrying and storing a gem faceting machine having a removable mast and faceting head and a plurality of lap wheels, a plurality of dop sticks and a plurality of containers for grinding compounds, and an open position to constitute a utility rack for convenient retrieval and use of said stored items;

a gem faceting machine, including:

a housing, an arbor mounted in said housing to spin about a vertical axis, a drive unit mounted in said housing and mechanically linked to said arbor to rotate said arbor, an upright mast removably connected to said housing to extend upward from said housing in a use orientation, a faceting head slidingly associated with said mast to be positioned along said mast at selectable positions;

a keyway having an open end attached to said housing for removably connecting said mast to said housing in an upright position, mast storage means attached to said housing for securing said mast to said housing in a storage position reoriented from its upright position, wherein said mast and faceting head are configured and adapted to be reorientably associated with said housing in a horizontal storage orientation;

a plurality of lap wheels configured and adapted to be connected to said arbor;

a plurality of dop sticks formed to be fastened to a gem and mounted in said stylus to facet such a gem against a said lap wheel connected to said arbor;

a plurality of grinding compounds adapted to be used on said lap wheels;

wherein said gem fastening machine, with said mast and faceting head in said storage position has said mast removed from its upright position and secured to said housing in a reoriented position, said plurality of lap wheels, said plurality of dop sticks, and said plurality of grinding compounds are sized, configured, and adapted to be stored in said case with said case in said closed position; and wherein said gem faceting kit has a first compartment sized and configured to receive said gem faceting machine in said storage orientation, a second compartment sized and configured to receive said lap wheels, and a third compartment sized and configured to receive said grinding compounds.

9. A gem faceting kit according to claim 8 further comprising a rinse dispenser sized, configured and adapted to be associated with said housing in a use position and to be stored in said case in a storage position.

10. A gem faceting kit according to claim 9, further comprising a catch basin sized, configured and adapted to be associated with said gem faceting machine in said used orientation and to be stored in said case.

11. A gem faceting kit according to claim 10, wherein said case further includes a fourth compartment sized and configured to receive said rinse dispenser and said catch basin.

12. A gem faceting kit according to claim 11, further comprising a lamp sized, configured, and adapted to be associated with said housing and to be stored in said case with said case in said closed position.

13. A gem faceting kit according to claim 8, further comprising a handle associated with said container whereby said kit may be transported by one hand of a user.

14. A gem faceting kit according to claim 13, wherein said container is less than about 2 cubic feet in volume.

15. A gem faceting kit according to claim 13, wherein said container is less than about 1 cubic foot in volume.

* * * * *